United States Patent [19]

Rodaway

[11] 3,993,351

[45] Nov. 23, 1976

[54] VERTICALLY ADJUSTABLE WHEELCHAIR ARM REST

[75] Inventor: Keith Samuel Rodaway, Santa Monica, Calif.

[73] Assignee: Everest & Jennings, Inc., Los Angeles, Calif.

[22] Filed: Nov. 3, 1975

[21] Appl. No.: 628,195

[52] U.S. Cl. ..... 297/422; 297/416; 297/417; 297/DIG. 4

[51] Int. Cl.[2] ..... A47C 1/12

[58] Field of Search ..... 297/411, 422, DIG. 4, 297/416–417

[56] References Cited

UNITED STATES PATENTS 3,853,372 12/1974 Meyer ..... 297/DIG. 4 X 3,891,229 6/1975 Gaffney ..... 297/DIG. 4 X

*Primary Examiner*—James C. Mitchell

*Attorney, Agent, or Firm*—Ralph B. Pastoriza

[57] ABSTRACT

Each of the padded arm rests of a wheelchair are supported by downwardly extending telescoping tubes received in correspondingly positioned vertical tubes secured to the frame of the wheelchair. A locking device biased to a normally locked position causes a projection to extend into registered openings in the telescoping tubes so that the arm rest can be positioned at a selected height. The locking arrangement defines a large exposed engaging surface which can easily be urged in a proper direction to release the lock by a portion of the body of a patient seated in the wheelchair.

2 Claims, 5 Drawing Figures

VERTICALLY ADJUSTABLE WHEELCHAIR ARM REST

This invention relates generally to wheelchairs and more particularly to improved vertically adjustable wheelchair arm rests.

BACKGROUND OF THE INVENTION

Various arrangements have been proposed and many are in present use today for varying the vertical height of the padded arm rests normally provided on either side of a wheelchair seat. A major problem with all such systems as have been proposed is the difficulty for the wheelchair patient himself to effect the desired vertical adjustment. For example, where telescoping tubes are employed a small button detent type structure is often utilized to lock the telescoping tubes in selected positions. No difficulty is normally encountered with properly positioning the arm rests at a selected position by a nurse or other attendant. On the other hand, it is oftentimes very difficult for a wheelchair patient particularly when the use of his arms and hands may be impaired to negotiate the necessary actions to release the telescoping tubes to permit adjustment of the arm rests.

It would be desirable in view of the foregoing if the vertical adjustability of wheelchair arm rests could be easily operated by a patient seated in the wheelchair rather than having to rely on a nurse or attendant to effect the desired adjustment.

BRIEF DESCRIPTION OF THE PRESENT INVENTION

Bearing the above in mind, the present invention contemplates a vertically adjustable wheelchair arm rest assembly positioned on each side of the seat of a wheelchair wherein there are provided vertical telescoping means mounting the underside of the arm rest to the side of the wheelchair. A specially designed locking means in accord with the invention is coupled to the telescoping means for locking the telescoping means in any one of a series of selected telescoped positions when in a first position so that the arm rest may be supported at a selected height above the plane of the seat. The locking means itself defines a fully exposed engaging surface which can readily be engaged by a portion of a patient's body while the patient is seated in the wheelchair to physically move the locking means to a second position in which the telescoping means is unlocked so that the elevated height of the arm rest can be easily changed by the patient himself.

With the foregoing arrangement, most wheelchair patients can effect the desired vertical arm rest adjustment without the aid of a nurse or attendant.

BRIEF DESCRIPTION OF THE DRAWINGS

A better understanding of this invention will be had by referring to a preferred embodiment thereof as illustrated in the accompanying drawings in which.

DETAILED DESCRIPTION OF THE PREFERRED EMBODIMENT

Figure 1:
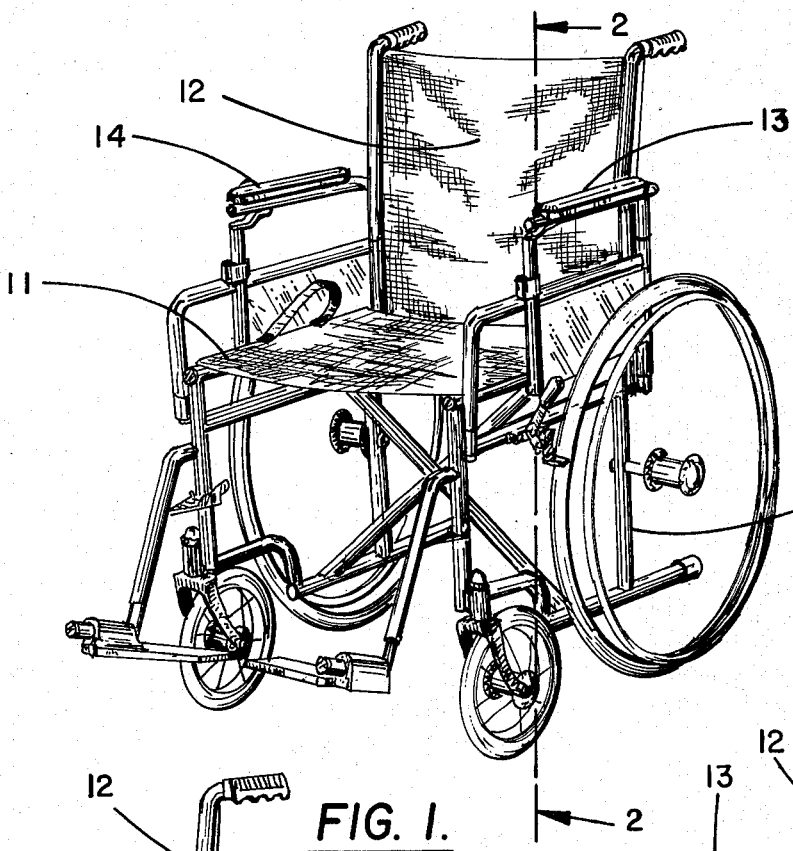
FIG. 1 is a three quarter front perspective view of a wheelchair incorporating vertically adjustable padded arm rests in accord with the present invention.

Referring first to FIG. 1, there is shown a wheelchair having a main frame structure 10 supporting a seat 11 and back rest 12. Left and right arm rest pads 13 and 14 are provided and arranged to be vertically adjusted in height as will become clearer as the description proceeds.

The arm rest assemblies associated with each of the arm rests are identical and therefore a detailed description of one will suffice for both.

Figure 2:
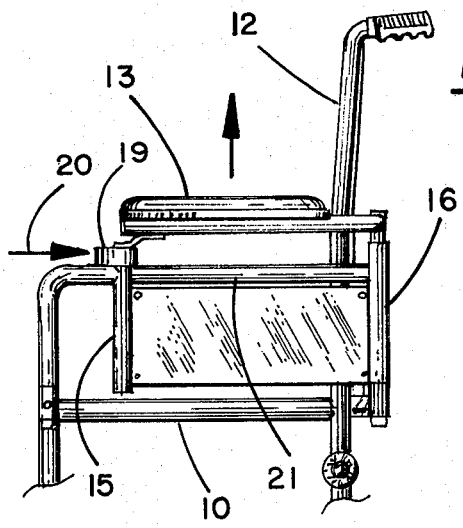
FIG. 2 is a fragmentary side elevational view of the chair looking in the directon of the arrows 2—2 of FIG. 1 and showing an arm rest in its lowest position.
Figure 3:
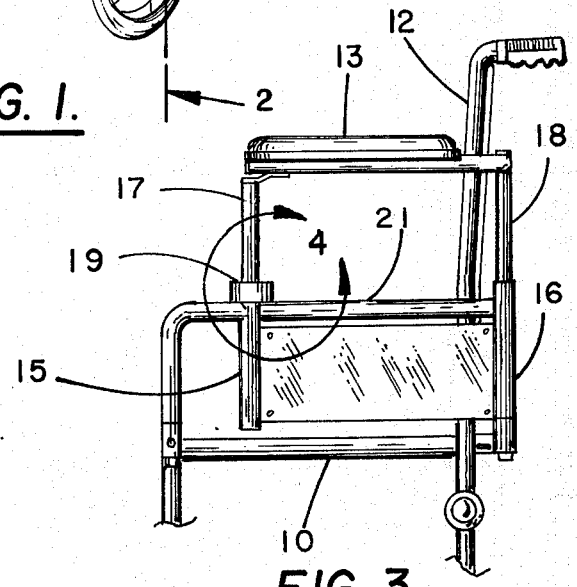
FIG. 3 is a view similar to FIG. 2 but illustrating the arm rest in an elevated position.

Referring in detail to FIGS. 2 and 3, the assembly associated with the arm rest 13 includes front and rear vertical parallel tubes 15 and 16 supported by the frame structure 10. As best seen in FIG. 3, the assembly further includes front and rear downwardly extending parallel arm rest support tubes 17 and 18 secured to the underside of the padded arm rest 13 and respectively telescopically received in the vertical tubes 15 and 16.

As indicated in both FIGS. 2 and 3, there is provided a movable locking means having an external oval collar 19. The forwardly facing surface portion of this collar defines a fully exposed engaging surface for engagement by a portion of a patient's body when the patient is seated in the wheelchair. The engagement force or pressure is applied in the direction of the arrow 20 pointing towards the engaging surface on the collar 19. As will become clearer as the description proceeds, the collar 19 is normally biased to a forward first position as illustrated in FIG. 2 wherein the front telescoping tubes are locked together. When pressure is applied as indicated by the arrow 20 of FIG. 2 the collar 19 moves in a straight line to a second position when the telescoping tubes 15 and 17 are unlocked so that the arm rest 13 can be vertically adjusted. The movement of the collar 19 is guided along a horizontal tube 21 constituting part of the wheelchair frame 10. It will be appreciated accordingly that a patient's elbow or forearm can simply be pressed against the engaging surface to shift or move the collar and effect the desired adjustment.

Figure 4:
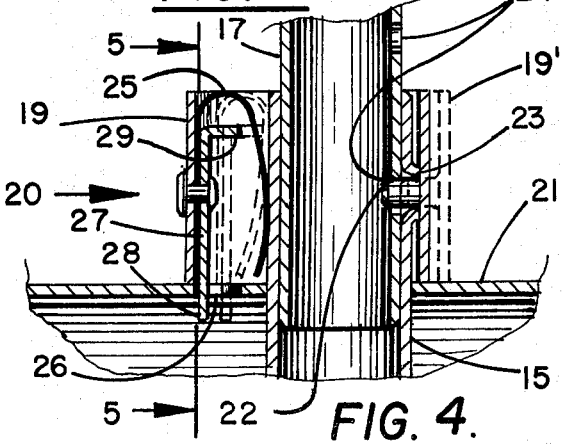
FIG. 4 is an enlarged fragmentary cross section of a locking means portion enclosed within the circular arrow 4 of FIG. 3; and, FIG. 5 is a cross section taken in the direction of the arrows 5—5 of FIG. 4.

Referring now to FIG. 4, further details of the locking means of which the collar 19 constitutes a portion will be described.

In FIG. 4, it will be noted that the horizontal frame tube 21 intersects the upper portion of the front vertical tube 15, the same being welded or otherwise secured thereto. This point of intersection is at a spaced distance below the upper end of the vertical tube 15 so that a portion of the vertical tube extends within the collar 19, this collar resting on the horizontal frame tube.

The inner rear wall of the collar has a forwardly directed projection 22 while the upper rear wall of the front vertical tube 15 has an opening 23 receiving this projection.

Also evident in FIG. 4 is the lower end of the front arm rest support tube 17 telescopically received in the front vertical tube 15, the support tube 17 having a series of longitudinally spaced openings 24 any one of which may be brought into registration with the opening 23 receiving the projection 22.

In FIG. 4, the solid line position of the collar and projection 22 defines a locking position for the telescoping tubes 15 and 17, the projection 22 being shown as extending through both openings 23 and 24. Thus in this solid line position, the telescoping tubes 15 and 17 are locked in their telescoped relationship.

The locking means also includes a spring means in the form of a folded leaf spring 25 between the inner front wall of the collar and the exterior rear portion of the upper end of the front vertical tube 15. This spring biases the oval shaped collar forwardly or in a leftward direction as viewed in FIG. 4 along the horizontal frame tube 21 thereby urging the projection 22 into the aligned opening 24.

When pressure is now applied to the collar 19 in the direction of the arrow 20 of FIG. 4, the collar will move in a straight line path along the horizontal tube 21 rearwardly or to the right as viewed in FIG. 4 to the dotted line position wherein it will be noted that the projection 22 is removed from the opening 24 so that the arm rest support tube 17 can now telescope freely up and down within the vertical tube 15. When pressure is removed from the front engaging surface of the collar 19, the spring 25 will simply bias the collar in a forward or left direction as viewed in FIG. 4 which will cause the end of the projection 22 to engage the outer wall of the arm rest support tube 17 until a registering opening 24 is juxtaposed the projection 22 at which point it will snap into position thereby locking the telescoping tubes to support the arm rest at a selected height.

In order to assure stable operation and avoid possible canting of the collar in its motion, the locking means is completed by the provision of a guide means which includes a guide slot 26 running longitudinally in a portion of the horizontal tube 21 and cooperating guide member 27. It will be noted that the lower end of the guide member 27 is keyed in the slot 26 as at 28 for horizontal movement and secured to the interior of the collar for movement with the collar. The upper portion of the guide member 27 terminates in a rearwardly directed stop 29. The rearward extent of the stop 29 is such that this stop will engage the front wall of the front vertical tube 15 when the collar has been urged rearwardly sufficiently to remove the projection 22 from an opening 24 in the forward arm rest tube 17 but before the projection is removed from the projection receiving opening 23 in the rear wall of the front vertical tube. This relationship is indicated by the dotted line phantom showing of the position of the collar 19 after it has been urged rearwardly or to the right in FIG. 4 to unlock the telescoping members, the phantom line position being indicated at 19'.

With respect to the foregoing, the receiving opening 23 may have a peripheral wall portion peened outwardly or to the right as viewed in FIG. 4 to provide an appreciable axial extent for the opening. It will be appreciated, accordingly, that the collar 19 is guided for straight line movement between the solid and dotted line positions by both the keying of the guide member 27 and the slot 26 and the riding of the projection 22 in the receiving opening 23.

Figure 5:
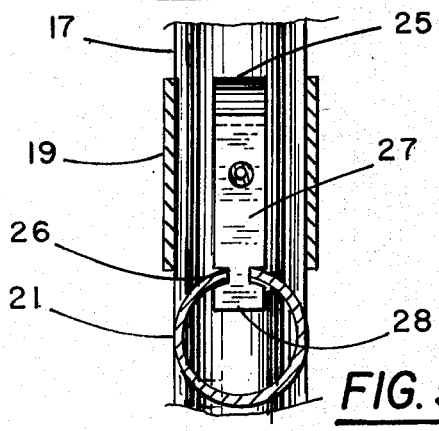

In the fragmentary cross section of FIG. 5, the keying portion 28 of the guide member 27 within the slot 26 is clearly illustrated.

OPERATION

The operation of the present invention will be evident from the foregoing description. If a patient in the wheelchair of FIG. 1 wishes to change the height of the arm rests, he need only engage the fully exposed front surface portion of one collar associated with one of the arm rests with a portion of his body, such as a forearm. The patient can then utilize his other forearm to lift under the associated padded arm rest to move it to the desired position, the telescoping forward tubes being unlocked by the rearward pressure exerted on the collar. The patient then releases the collar and the biasing spring will snap the projection into registered openings, gravity lowering the arm rest to the first opening which falls into registration with the opening 23 described in FIG. 4.

The operation is repeated for the other arm rest.

It will be appreciated that even if the patient is fitted with artificial arms which could not function readily to operate a conventional type of detent button, the arm rest adjustments may still be carried out it only being necessary that the rearward pressure be exerted on the collar and some other portion of the patient's body be utilized to raise the arm rest, From the foregoing description, the present invention thus provides a greatly improved vertically adjustable wheelchair arm rest which in most instances can easily be operated by the patient himself, all to the end that nurses or attendants are not required to be present at every moment to assure the patient's maximum comfort.

What is claimed is:

1. In combination with a wheelchair frame structure supporting a seat and back rest, vertically adjustable arm rest assemblies in elevated positions on either side of said seat, each of said arm rest assemblies including:

a. front and rear vertical parallel tubes supported by said frame structure;

b. a padded arm rest;

c. front and rear downwardly extending parallel arm rest support tubes secured to the underside of said padded arm rest and respectively telescopically received in said vertical tubes, said frame structure including at each side an horizontal frame tube intersecting the upper portion of the front vertical tube at a spaced distance below its upper end;

d. an oval shaped collar surrounding the upper end of said front vertical tube and resting on said horizontal frame tube, the inner rear wall of said collar having a forwardly directed projection and the upper rear wall of said vertical tube having an opening receiving said projection, the front arm rest support tube telescopically received within the front vertical tube having a series of longitudinally spaced openings in its rear wall any one of which may be brought into registration with said opening receiving said projection; and, e. a spring means between the inner front wall of said collar and the exterior front portion of the upper end of said first vertical tube to bias said oval shaped collar forwardly along said horizontal frame tube thereby urging said projection into one of said series of longitudinally spaced openings in said front arm rest support tube so that said arm rest may be supported at a selected height above the plane of said seat, the outer front surface of said collar defining a fully exposed forwardly facing engaging surface for pressing engagement by a portion of a patient's body when the patient is seated in the wheelchair to physically move the collar from its biased position to a position in which the forward tubes are unlocked so that the selected height of the arm rest can be easily changed by the patient.

2. The subject matter of claim 1, in which the top wall of said horizontal frame tube under said collar includes a longitudinal guide slot; and a guide member keyed in said slot for horizontal movement and secured to the interior of said collar for movement with said collar, the upper portion of said guide member terminating in a rearwardly directed stop for engaging the front wall of said front vertical tube when said collar has been urged rearwardly sufficiently to remove said projection from an opening in the forward arm rest support tube but before the projection is removed from the projection receiving opening in the rear wall of said front vertical tube, whereby canting of said collar is prevented when manually moved in said slot by said guide member and by said projection moving in said rear opening of said front vertical tube.

* * * * *